US011229994B2

(12) United States Patent
Friberg

(10) Patent No.: US 11,229,994 B2
(45) Date of Patent: Jan. 25, 2022

(54) METHOD FOR DETECTING IF A FASTENER IS ALREADY TIGHTENED

(71) Applicant: ATLAS COPCO INDUSTRIAL TECHNIQUE AB, Stockholm (SE)

(72) Inventor: Christian John Robert Friberg, Nacka (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 22 days.

(21) Appl. No.: 16/764,446

(22) PCT Filed: Nov. 6, 2018

(86) PCT No.: PCT/EP2018/080220

§ 371 (c)(1),
(2) Date: May 15, 2020

(87) PCT Pub. No.: WO2019/096615

PCT Pub. Date: May 23, 2019

(65) Prior Publication Data

US 2020/0361065 A1 Nov. 19, 2020

(30) Foreign Application Priority Data

Nov. 17, 2017 (SE) ..... 1730319-9

(51) Int. Cl.
*B25B 21/02* (2006.01)
*B25B 23/145* (2006.01)
*B25B 23/147* (2006.01)

(52) U.S. Cl.
CPC ..... *B25B 21/02* (2013.01); *B25B 23/1453* (2013.01); *B25B 23/1456* (2013.01); *B25B 23/1475* (2013.01)

(58) Field of Classification Search
CPC . B25B 21/02; B25B 23/1453; B25B 23/1456; B25B 23/147; B25B 23/1475
See application file for complete search history.

(56) References Cited

U.S. PATENT DOCUMENTS 6,167,606 B1 * 1/2001 Mueller ..... B23P 19/066 173/181
6,371,218 B1 * 4/2002 Amano ..... B25B 23/1405 173/176

(Continued)

OTHER PUBLICATIONS

International Search Report (ISR) and Written Opinion dated Feb. 12, 2019 issued in International Application No. PCT/EP2018/080220.

(Continued)

*Primary Examiner* — Andrew M Tecco
*Assistant Examiner* — Nicholas E Igbokwe
(74) *Attorney, Agent, or Firm* — Holtz, Holtz & Volek PC

(57) ABSTRACT

A method detects whether a fastener is already tightened using a tightening tool with a pulse mechanism. The method includes placing the tightening tool on the fastener, and accelerating rotational parts of the tightening tool. The rotational speed of the rotational parts is limited to a first rotational threshold value in revolutions per minute during an initial tightening phase, the first rotational threshold value being set to be in a range of 20% to 80% of a second rotational threshold value in revolutions per minute needed in a secondary tightening phase to provide a target fastening value for the fastener. And it is detected whether a pulse occurs during the initial tightening phase, the initial tightening phase being measured from a moment when the rotational parts are accelerated.

20 Claims, 3 Drawing Sheets

(56) References Cited

U.S. PATENT DOCUMENTS

| | | | | |
|---|---|---|---|---|
| 6,668,212 | B2 | 12/2003 | Colangelo et al. | |
| 9,469,019 | B2 | 10/2016 | Profunser et al. | |
| 2003/0009262 | A1* | 1/2003 | Colangelo, III | B25B 23/1456 700/275 |
| 2003/0121685 | A1* | 7/2003 | Yamamoto | B25B 21/00 173/217 |
| 2005/0263304 | A1* | 12/2005 | Sainomoto | B25B 21/026 173/2 |
| 2010/0263890 | A1 | 10/2010 | Profunser et al. | |
| 2013/0133911 | A1* | 5/2013 | Ishikawa | B25B 21/00 173/176 |
| 2014/0056660 | A1* | 2/2014 | Eshleman | B23B 51/009 408/9 |
| 2015/0135907 | A1* | 5/2015 | Hirabayashi | B25B 23/1475 81/54 |
| 2016/0318164 | A1* | 11/2016 | Baker | B25B 23/14 |
| 2017/0165817 | A1 | 6/2017 | Vogt et al. | |

OTHER PUBLICATIONS

International Preliminary Report on Patentability dated Sep. 30, 2019 issued in in International Application No. PCT/EP2018/080220.

* cited by examiner

METHOD FOR DETECTING IF A FASTENER IS ALREADY TIGHTENED

TECHNICAL FIELD

The invention relates to the field of tightening tools having a pulse mechanism and in particular relates to a method for detecting if a fastener such as a nut, bolt or screw has been tightened previously and avoiding that such a tightened bolt is tightened further over its predetermined torque limit or angle rotational limit. The method comprises the steps of limiting a first rotational threshold value in revolutions per minute during an initial tightening phase to a range of 20% to 40% of a second rotational threshold value in revolutions per minute needed in a secondary tightening phase to provide a target fastening value for said fastener; and detecting whether a pulse occurs during the initial tightening phase, said initial tightening phase being measured from the moment when the rotational parts of the tightening tool are accelerated.

BACKGROUND OF THE INVENTION

In industrial applications such as the manufacturing industry, for example car manufacturing industry, fasteners such as bolts, nuts and/or screws are used to keep at least two elements together to form a joint. These elements may by parts that need to be connected to other parts, parts that need to be connected to sheet metals or two sheet metals. These fasteners are tightened using tightening tools, such as electronic tightening tools, pneumatic tightening tools or hydraulic fastening tools, whereby these tools comprise a pulse mechanism in order to provide a certain predetermined torque to ensure the quality of the joint.

In manufacturing plants the pace nowadays is very high and the operators are under a lot of pressure to perform and keep up to speed in order to keep the production line smooth and going. This is the production line may be exposed to human error for instance when tightening tools are manually guided and operated by an operator. One problem that can occur is when already tightened fasteners are, at least initially, tightened again. Such a "rehit" can lead to a higher torque than originally planned for the specific joint, since the pulse mechanism starts to work from the beginning of the tightening phase and the first hit of the tightening tool and the pulse mechanism, respectively, comprises a comparably high energy—and thus torque level. A "rehit" can lead to a fastener that is tightened harder than specified.

"Rehit" can also be explained by referring to the fastening of car wheels. If it is assumed that a car wheel is fastened to the car hub by five fasteners, then the "rehit" occurs when the fasteners 1 to 5 have been tightened using an automatic tightening tool, such as electric tightening tool, and the operator connects the tightening tool to anyone of the already tightened fasteners 1 to 5 again and starts the automatic tightening process one more time. What will happen is that the tightening tool will pulse at least one time and thereby tighten the fastener above the specified torque, which is typically around 90 to 180 Nm depending on car model.

In industrial applications angle controlled tightening tools or torque controlled tightening tools are used.

Angle controlled tightening tools are for example used when a bond or joint with consistent stiffness and variable friction has to be tightened, while bonds or joints with consistent friction and variable stiffness favour torque controlled tightening tools. Angle controlled tightening tools work by predetermining how many times the screw needs to rotate (angle) until the bond or joint is considered to be tightened. An output shaft is disconnected from the drive means or rotating parts of the tightening tools as soon as the target angle is reached. As mentioned joint stiffness may affect the outcome while friction does not.

Contrary to angle controlled tightening tools, torque controlled tightening tools measure the torque that is applied to the fastener and disconnect the drive means or the rotating parts of the output shaft as soon as the predetermined or target torque is reached. As mentioned above friction can affect the outcome while joint stiffness does not.

When the tightening tool is an angle controlled device then the risk for tightening the fastener above its limit is particularly high when a "rehit" occurs, thus when the tightening tool is put on fastener A twice, even after it has already been tightened. This may for instance happen when a certain number of fasteners, for example fasteners A-F, have been tightened and then the operator lost track after fastener F and puts the tightening tool again on fastener A. Due the angle control the tightening tool will apply a comparable high energy to the fastener from the very start of tightening phase since the tightening tools software will assume that the fastener is not yet tightened and the target angle should be applied;—thus it has no reason to go with a slow rotational speed or with limited energy since it is set on the target angle and assumes that the fastener is not yet tightened.

When a torque controlled tightening tool is used then the risk of tightening a fastener above a predetermined torque limit is lower but it still exists since the applied energy may also be quite high from the very start of the tightening phase but since the torque is measured from the moment the tightening tool is connected to the fastener the risk is lower.

There are thus certain problems when operating automatic tightening tools in industrial environments as described above.

SUMMARY OF THE INVENTION

An object of the present invention is to provide a method for controlling a tightening tool that reduces the risk of producing overtightened joints.

A further object of the present invention is to provide a method for controlling a tightening tool that is reliable and reduces the risk of providing joints or fasteners that do not pass quality control.

Another object of the present invention is to provide a tightening tool that is efficient and economic.

The inventor of the present invention has realized that it is possible to provide a method that allows to detect, during an initial tightening phase, if a fastener has been previously tightened as specified and to avoid that such a tightened fastener is not tightened further above a specified tightening limit if the tightening tool is applied to it again. It has been discovered that this can be done even without generating a substantial time loss in the process. The inventor has further discovered that his is possible no matter if the tightening tool is angle controlled or torque controlled.

Disclosed herein is a method for detecting if a fastener is already tightened or not using a tightening tool with a pulse mechanism wherein the method comprises the steps of:

- placing the tightening tool on the fastener;
- accelerating the rotational parts of the tightening tool;
- limiting a rotational speed of the rotational parts to a first rotational threshold value in revolutions per minute during an initial tightening phase, the first rotational threshold value being chosen to be in a range of 20% to 80%, 30% to 80% or 40% to 80% of a second rotational threshold value in revolutions per minute needed in a secondary tightening phase to provide a target fastening value for said fastener; and detecting whether a pulse occurs during the initial tightening phase, said initial tightening phase being measured from a moment when the rotational parts are accelerated.

The above method allows to determine if the fastener is already tightened or not during the initial phase of the tightening and therefore it avoids the further tightening of an already tightened fastener. The presence or non-presence of a pulse during the initial tightening phase may be enough to determine whether or not the fastener is tightened or not. If a pulse is present it can theoretically be determined that the fastener is tightened and that a "rehit" is present. If no pulse is present it can be determined that the fastener has not been tightened previously and that no "rehit" is present.

The initial tightening phase is being measured as soon as the rotational parts of the tightening tool start to rotate or accelerate.

The range of 20% to 80% and 30% to 80% and 40% to 80%, respectively, of a second rotational threshold value in revolutions per minute needed in a secondary tightening phase to provide a target fastening value for said fastener, is chosen so that an initial rotational speed provides detectable pulses, if they occur, whereby such pulses generate torque values that are lower than the tightening tools lowest target torque. For the tool illustrated, this value is about 1000 Revolutions per Minute but this value can of course be adapted to other tightening tools depending on model, type and size.

It is to be noted that the above second rotational threshold value refers to the actual tightening phase and not the driving down phase. The driving down phase, thus the phase in which the fastener is screwed in until the joint is snug, is done previously to the actual tightening phase. The actual driving down phase may be done with a rotational speed chosen by the operator;—however in order to tightening the joint as fast as possible the rotational speed during the driving down phase may be chosen to be comparably fast, for instance at least the same or faster as the first rotational threshold value.

The secondary tightening phase may comprise the above described driving down phase and the actual tightening phase. The range(s) of 20% to 80% and 30% to 80% and 40% to 80%, respectively, of the second rotational threshold value in revolutions per minute needed in a secondary tightening phase refer to the actual tightening phase, which happens towards the end of the secondary tightening phase.

In an embodiment the method may comprise the step of determining a torque value of said pulse, if the pulse occurs.

Determining the torque value of the pulse, if the pulse occurs, may provide further information about the state of the joint.

After determining the torque value of the pulse, if the pulse occurs, the method may comprise the step of aborting the tightening, if the torque value is corresponding to or above a predetermined torque threshold value.

This step prevents the fastener from being tightened to a value above a specified limit.

Alternatively, if no pulse is detected the method may comprise the step of accelerating the rotational parts of the tightening tool up to the second rotational threshold value.

The above may mark the transition from the initial tightening phase to a secondary tightening phase, in which secondary tightening phase the fastener is tightened up to its specified torque or angle value.

The acceleration of the rotational parts of the tightening tool up to the second rotational threshold value, may also be performed if the torque value is below the predetermined torque threshold value.

In particular when high frictional joints are present a pulse may occur during the initial tightening phase, although such a pulse may be comparably weak, even though the fastener is actually not tightened.

If no pulse is detected it is safe to assume that the fastener was not previously tightened and thus tightening may proceed to the secondary tightening phase and the energy, in particular the rotational energy, needed to tighten the fastener as specified may be applied.

The above described situations "no pulse" and "torque value below the predetermined torque threshold value" may thus transfer the tightening from the initial tightening phase to the secondary tightening phase.

The length of the initial tightening phase may be measured in time and it may be in the range of 100 ms to 200 ms, preferably in the range of 120 ms to 180 ms and more preferably in the range of 125 to 160 ms.

These comparably short time limits may help to reduce the time loss for the detection if the fastener is already tightened or not.

Alternatively the initial tightening phase may be measured in angle and it may be in the range of 180° to 1080°, preferably 360° to 720° and more preferably 430° to 650°.

The above described measurement of the initial tightening phase may depend on if an angle controlled or torque controlled tightening tool is used.

The above stated values for the initial tightening phase in time and/or angle are chosen in order to provide a high probability that a detectable pulse occurs, if the fastener was previously tightened, during the initial tightening phase. The actual time or angle depends on the functioning of the pulse mechanism, the rotational speed and how the motor accelerates. In order to save time it is thereby desirable to keep the time and/or angle as low as possible.

In an embodiment the target fastening value may be a target torque value and the predetermined torque threshold value may be in a range of 7 Nm to 12 Nm, preferably 8 to 11 Nm and more preferably 8.5 Nm to 10 Nm.

The above mentioned torque threshold value ranges allow to provide a fairly good judgment if the fastener is tightened or not. If the detected torque value is corresponding to—or above the predetermined threshold torque value then the fastener is tightened, if not it can be assumed that it is not tightened.

The first rotational threshold value may be in the range of 800 revolutions per minute to 1200 revolutions per minute, preferably about 900 to 1100 revolutions per minute.

The above rotational threshold value may provide for sufficient energy in order to provide for a sufficiently strong pulse during the initial tightening phase.

In an embodiment the second rotational threshold value may be in the range of 2000 revolutions per minute to 4000 revolutions per minute, preferably about 2500 revolutions per minute to 3500 revolutions per minute and more preferably about 2800 revolutions per minute to 3200 revolutions per minute.

The above second rotational threshold value may be applied or used during a secondary tightening phase in order to provide sufficient rotational energy so that the fastener can actually be tightened as specified.

The target fastening value may be a target torque value or target angle value, depending if the tightening tool is angle controlled or torque controlled.

The tightening tool may be an electronic tightening tool, a pneumatic tightening tool or a hydraulic tightening tool.

In an embodiment the method may further comprise the step of signaling to the operator that the fastener is already tightened.

This may for instance be done visually by light, tactile by vibration or acoustically via an acoustic signal.

Disclosed herein is also a tightening tool comprising a pulse mechanism, a motor, a drive member, a measurement unit and a processing unit, the motor being configured to drive the drive member, the pulse mechanism being configured to rotate along with the drive member, the measurement unit being configured to measure an angle, an applied torque and pulse and/or time, said measurement unit being connected to the motor and the pulse mechanism, respectively, and the processing unit being connected to the measurement unit, wherein the processing unit may be configured to perform any of the steps described above.

The above given absolute values are for a certain application of the tightening tool and they are in no way limiting to the invention. The values may vary depending on the size, requirements, surroundings, etc. of the joints to be tightened. Thus these values may be greater or less as given above. It is clear that the values are not the same for the assembly of a consumer electronic device and a heavy industry machine, respectively.

BRIEF DESCRIPTION OF THE DRAWINGS

The present invention will now be described, for exemplary purposes, in more detail by way of an embodiment and with reference to the enclosed drawings, in which.

DETAILED DESCRIPTION

Figure 1:
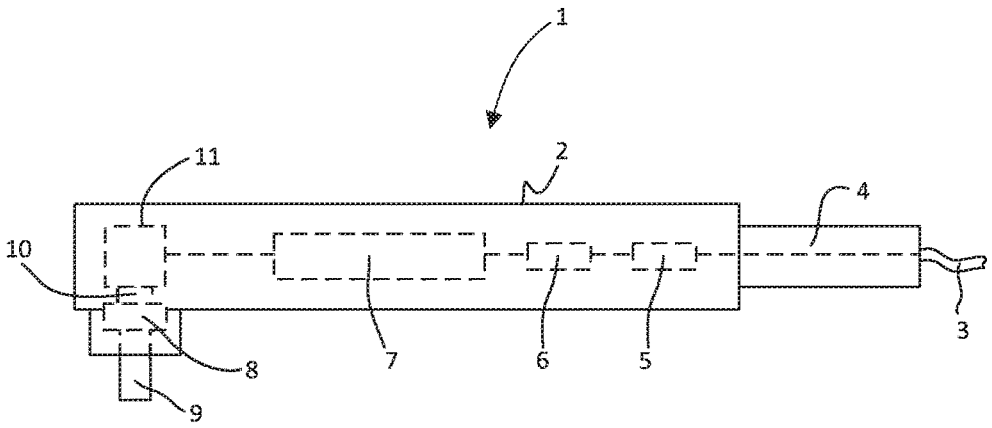
FIG. 1 schematically illustrates a tightening tool according to an embodiment of the present invention.

FIG. 1 schematically illustrates an automatic tightening tool 1 comprising a housing 2 and power cable 3 connected to the housing 2. The housing 2 may comprise a handle 4 so that an operator can easily hold the tightening tool 1. In the housing 2 an electric transformer unit 5 connected to the power cable 3 is provided. The electric transformer unit 5 is connected to a measurement unit 6, which is connected to a processing unit 7. The processing unit 7 is connected to a motor 11 in order to control and power the motor 11. The motor 11 comprises a drive member 10, which drive member 10 again comprises a pulse mechanism 8, which pulse mechanism 8 is configured to rotate along with the drive member 10.

The automatic tightening tool 1 is illustrated having a power cable 3, the present invention is however also suitable for battery-driven automatic tightening tools or automatic tightening tools powered by compressed air.

The drive member 10 and the rotating parts of the motor 11 are the rotational parts of the tightening tool 10.

The pulse mechanism 8 is connected to an output shaft 9, which output shaft 9 is configured to be connected to an adapter (not shown) or the like so that a fastener (not shown) can be coupled to the adapter and the output shaft 9, respectively.

Although the output shaft 9 is configured to rotate in order to tighten fasteners, it is not considered to be part of the rotational parts herein.

The processing unit 7 is configured and programmed to control the motor during the tightening of a fastener using the tightening tool 1. The measurement unit 6 is configured to measure the applied torque through the output shaft 9 and the angle of rotation of the output shaft 9 and the rotational parts 10, 11, respectively. Depending on the tightening phase and the state of the fastener the output shaft the processing unit 7 is configured to abort the tightening, if it is detected that the fastener is already tightened with a torque value corresponding to or above predetermined torque threshold value or accelerate the rotational parts to tighten the fasteners as specified if the torque value is below the predetermined torque threshold value. The torque value is monitored and measured via the measurement unit 6.

For the pulse mechanism 8 to work and actually apply pulses of a certain torque to the output shaft 9 a certain rotational speed of motor 11 and the drive member 10, respectively, is required. In other words the speed of rotation of the rotational parts 10, 11 defines what torque or angle can be applied to the fastener via the output shaft 9.

The electric transformer unit 5, the measurement unit 6, the processing unit 7, the motor 11, the drive member 10 and the pulse mechanism 8 are illustrated in dashed lines in FIG. 1, since they are embedded in the housing 2 and thus not directly visible. These units are shown for illustrative purposes.

In order to better understand the tightening of a fastener and the method according to the present invention it is now referred to FIGS. 2*a* to 2*d*.

FIGS. 2*a* to 2*d* illustrate the course or development of the rotational speed during a tightening of a fastener or bolt over time. The rotational speed (RPM) is illustrated on the left y-axis while the x-axis illustrates the time passed, typically in milliseconds.

Figure 2A:
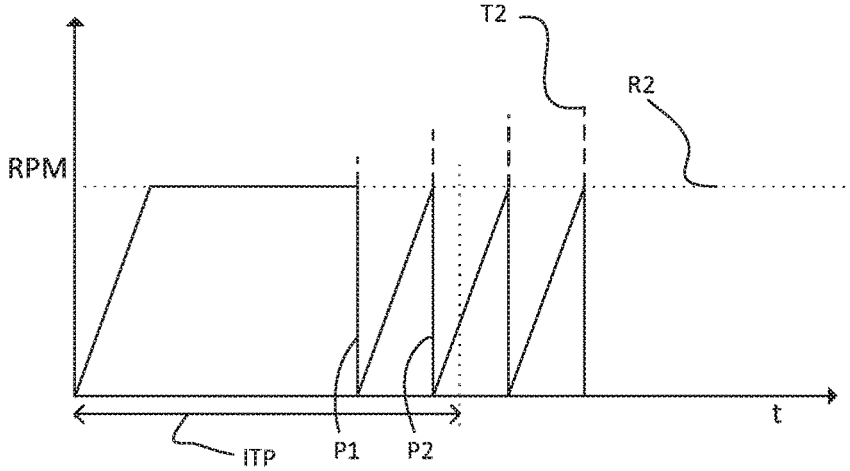
FIG. 2*a* schematically illustrates a diagram illustrating the rotational speed development over time according to a known method.

FIGS. 2*a* to 2*d* illustrate various situations that can occur during a tightening of a fastener, whereby FIG. 2*a* illustrate a known technique according to the prior art. The rotational speed may be measured directly on a drive axle of the motor 11 or in the pulse mechanism 8. It is to be noted that the rotational speed measured at the drive axle or in the pulse mechanism 8 does not need to correspond to the rotational speed of the output shaft 9.

FIG. 2*a* illustrates a rotational speed development over time of the rotational parts of an automatic tightening tool using a previously known method. FIG. 2*a* shows how the rotational speed develops over time when a fastener that has not been tightened previously up to a target fastening value T2 is tightened. The rotational parts 10, 11 are accelerated and torque or angle movement/rotation is applied to the fastener in order to tighten a joint. Once resistance occurs during the tightening the speed of the rotational parts will drop abruptly and the pulse mechanism 8 will initiate a pulse P1 with a certain fastening value (illustrated as dashed lines in FIG. 2*a*), typically below the target fastening value T2. After the first pulse P1 the rotational parts are accelerated again to generate a second pulse P2 with a higher fastening value than the first pulse P1 but still below the target fastening value T2 and so on.

The fastening value peaks or torque value peaks are indicated in the FIGS. 2*a* to 2*d* with dashed lines for illustrative purposes. They occur whenever a pulse (P1, P2) occurs and the rotational speed drops to zero or at least close to zero. After the target fastening value T2 is reached the tightening is finished and stopped.

Figure 2B:
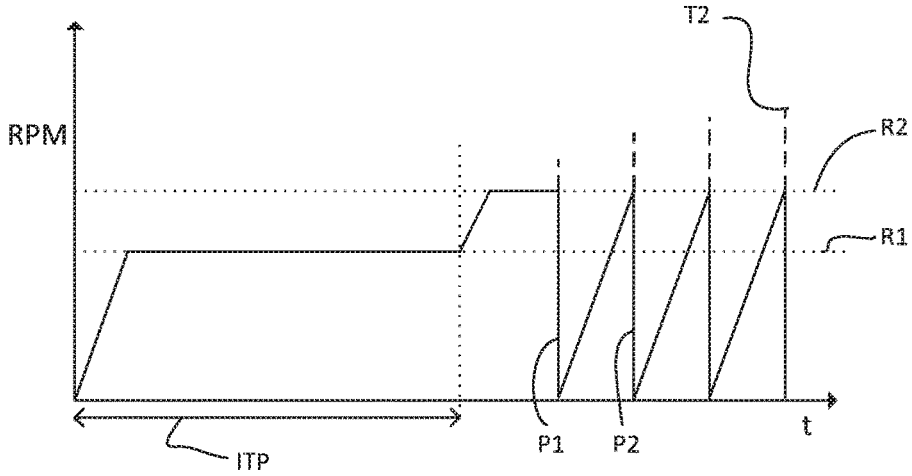
FIG. 2*b* schematically illustrates a diagram illustrating the rotational speed development over time using a method according to the invention.
Figure 2C:
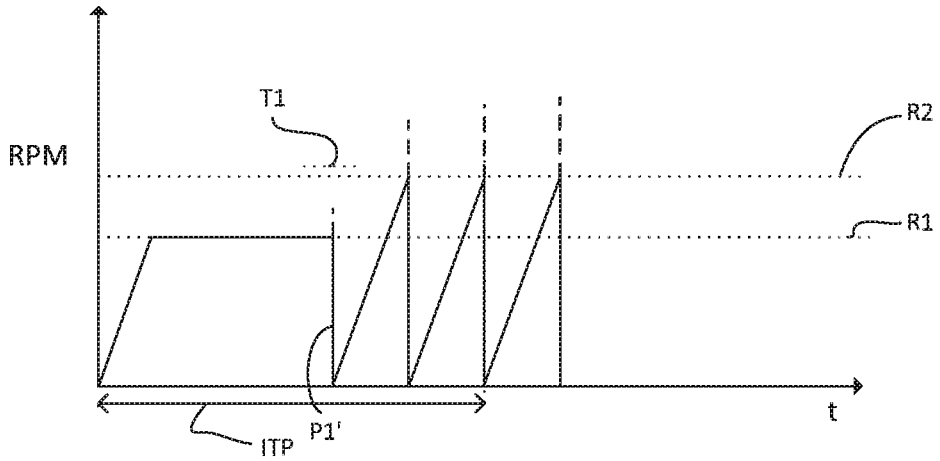
FIG. 2*c* schematically illustrates a diagram illustrating the rotational speed development over time under different circumstances than in FIG. 2*b* using the method according to the invention.
Figure 2D:
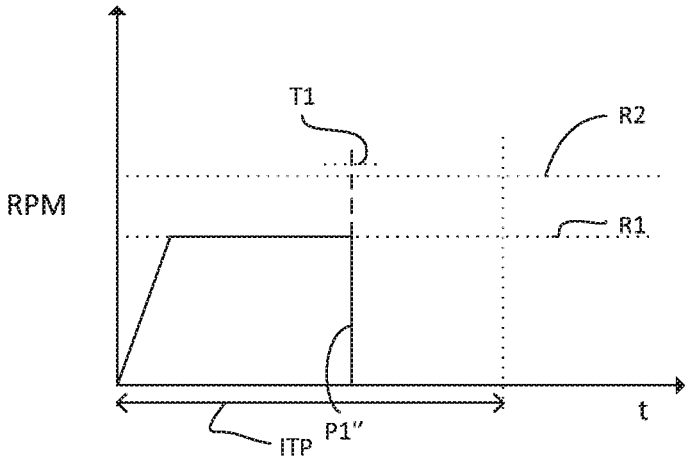
FIG. 2*d* schematically illustrates a diagram illustrating the rotational speed development over time under again different circumstances than in FIGS. 2*b* and 2*c* using the method according to the invention.

In FIG. 2*a* an initial tightening phase ITP is illustrated, whereby this is only done in order to properly compare FIGS. 2*b* to 2*d* with FIG. 2*a*. In FIG. 2*a* the initial tightening phase is not of interest. In the method according to FIG. 2*a* the rotation of the rotational parts is accelerated up to a second rotational threshold value R2, which is needed to tighten a fastener according to a specification and according to a target fastening value T2. FIG. 2*a* illustrates the normal case where a fastener that has not been previously tightened, is tightened. When a fastener that has been tightened already is tightened again using the known method according to FIG. 2*a* by accelerating the rotational parts immediately up to the second rotational threshold value R2, then the risk is high that the first pulse (not shown) or any subsequent pulse generates a fastening value or torque that is above the target fastening value T2 for said fastener and thereby generates a tightened fastener that cannot be approved since it is tightened with a higher value/torque than specified.

As mentioned, if the same procedure or known method illustrated in FIG. 2*a* is applied to an already tightened fastener the risk is high that such an already tightened fastener is tightened above the target fastening value T2, since the processing unit 7 will accelerate the motor 11 and drive member 10 directly and almost immediately up to a second rotational threshold value R2, which is needed to apply the target fastening value T2. In view of this a first rotational threshold value R1 (FIGS. 2*b*-2*d*) corresponding to a predetermined torque threshold value T1 is introduced.

FIG. 2*b* illustrates the rotational speed development of the rotational parts thus the motor and drive member 10 when an untightened fastener is tightened using the method according to the invention. In FIG. 2*b* it is well visible, that a first rotational threshold value R1 is introduced, said first rotational threshold value R1 being used to limit the applied torque during pulses occurring in the initial tightening phase ITP. As can be seen from FIG. 2*b* there is no pulse occurring during the initial tightening phase ITP and therefore after the initial tightening phase the rotational parts are accelerated up to the second rotational threshold value R2 and the tightening proceeds as previously explained referring to FIG. 2*a* until the target fastening value T2 is reached. FIG. 2*b* illustrates the normal case using the method according to the present invention.

FIG. 2*c* illustrates the tightening of a fastener when the fastener is not previously tightened but a pulse P1' occurs anyway during the initial tightening phase ITP. This can happen when there is dirt in the thread or when joint has parts with various stiffness. It has to be noted that the pulse P1' needs to be at least detectable. The measurement unit 6 then determines the torque value of the pulse P1' that occurred during the ITP. If the torque value (dashed line of first pulse P1') of the pulse P1' is below the predetermined torque threshold value T1, then it is assumed that the fastener has not been previously tightened. In FIG. 2*c* the torque value of the pulse P1' is comparably weak and below the predetermined torque threshold value T1 and therefor the tightening tool 1 and the processing unit 7, respectively, will increase the rotational speed up to the second rotational threshold limit R2 in order to tighten the fastener up to the specified target fastening value T2 and tighten the fastener as described referring to FIG. 2*a*. Alternatively the fastener may be tightened to the target fastening value T2 by keeping the rotational parts of the first rotational threshold value R1, this is however not shown in FIG. 2*c*. It is to be noted that the value of the predetermined torque threshold value T1 is only illustrated for understanding purposes the diagram only shows rotational speed versus time.

FIG. 2*d* illustrates the situation when an actual "rehit" occurs, thus when an already tightened fastener is connected to the automatic tightening tool and tried to be tightened again. As can be seen from FIG. 2*d* a pulse P1" also occurs during the initial tightening phase ITP whereby the value or torque value of this pulse P1" is determined by the measuring unit 6. The value of the torque of this pulse P1" is illustrated to be above (or corresponding to for that matter) to the predetermined torque threshold value T1. This leads to the conclusion that the fastener has been previously tightened due to the occurrence of a strong pulse P1" generating a torque corresponding to or above the predetermined torque threshold value T1. The tightening will thus be aborted and stopped. This can be signaled to the user.

Figure 3:
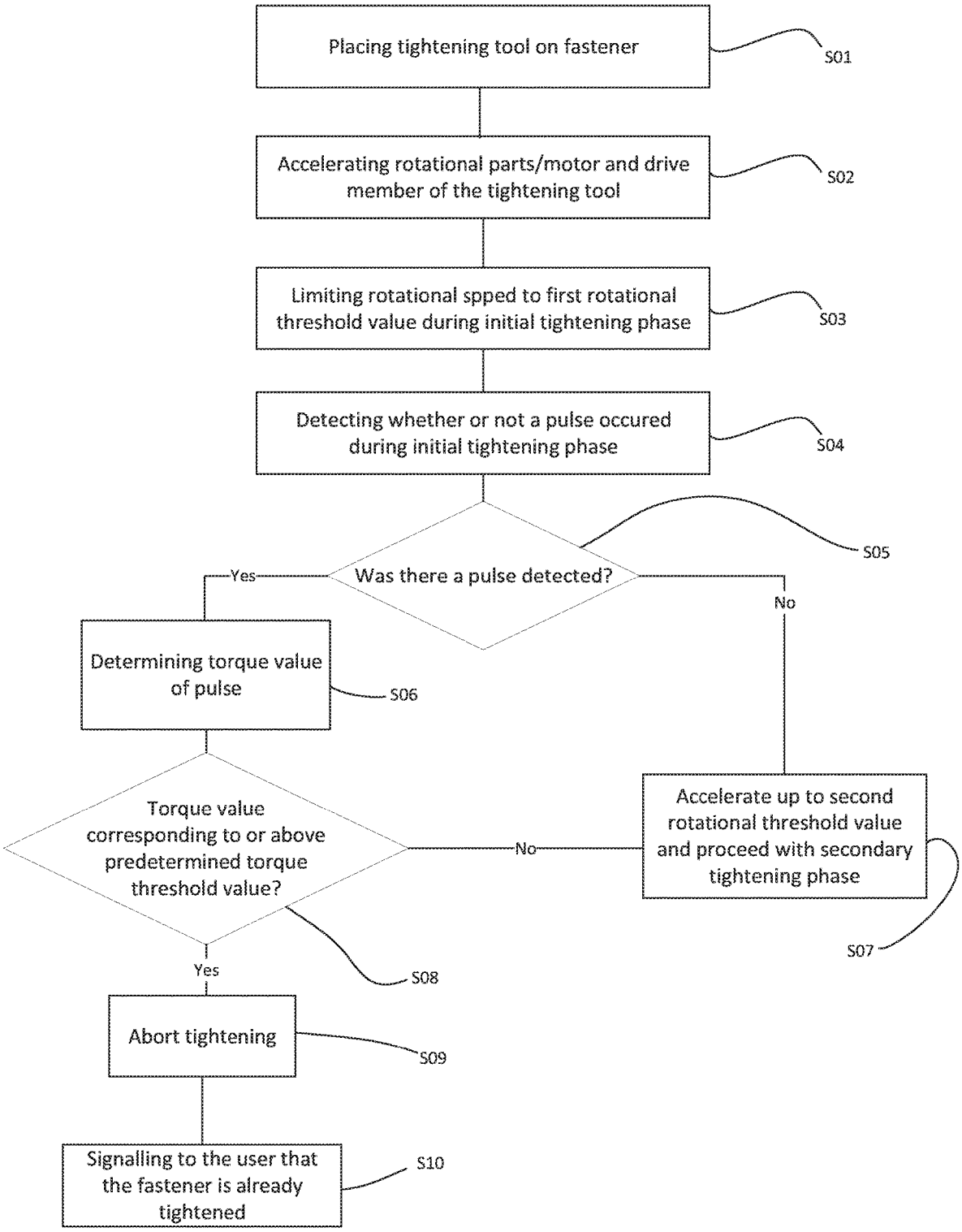
FIG. 3 illustrates a flow chart of a method according to an embodiment of the present invention.

FIG. 3 illustrates the method steps according to an embodiment of the invention. The method comprises the steps of:

placing S01 the tightening tool 1 on the fastener;

accelerating S02 the rotational parts 10, 11 of the tightening tool 1;

limiting S03 a rotational speed of the rotational parts 10, 11 to a first rotational threshold value R1 in revolutions per minute during an initial tightening phase ITP, the first rotational threshold value R1 being chosen to be in a range of 20% to 40% or 20% to 80%, or 30% to 80% or 40% to 80%, of a second rotational threshold value R2 in revolutions per minute needed in a secondary tightening phase to provide a target fastening value T2 for said fastener; and detecting S04 whether a pulse P1, P2, P1', P1" occurs during the initial tightening phase ITP, said initial tightening phase ITP being measured from a moment when the rotational parts 10, 11 are accelerated up to a certain length measured in time.

The above steps S01 to S04 can theoretically already allow to determine if the fastener has been previously tightened or not. It may be decided based on the presence of a pulse P1, P2, P1', P1" that the fastener has been previously tightened thus a pulse P1, P2, P1', P1" was detected S04 or that the fastener has not been previously tightened thus no pulse P1, P2, P1', P1" was detected.

In particular if the joints with consistent friction and variable stiffness are tightened the presence of a pulse P1, P2, P1', P1" can be enough to decide/assume that the joint has been previously tightened.

If no pulse P1, P2, P1', P1" is detected, step S05, then the rotational parts 10, 11 are accelerated S07 up to the second rotational threshold value R2 corresponding to a target fastening value T2 for tightening the fastener up to the target fastening value T2.

If a pulse P1, P1' is detected in the initial tightening phase ITP, during step S05, then the torque value of the pulse P1, P1' is determined S06 and if the torque value is corresponding to or above a predetermined torque threshold value T1 then tightening is aborted S09. If the torque value of the pulse P1, P1' is below the predetermined torque threshold value T1, then the rotational parts 10, 11 may be accelerated S07 up to a second rotational threshold value R2 in order to provide the target fastening value T2, as described above. This further acceleration up to the second rotational threshold value R2 also marks the beginning of a secondary tightening phase which follows the initial tightening phase ITP. The secondary tightening phase will only happen if no pulse or a pulse with a torque value below the predetermined torque threshold value T1 is present. The stop or abortion S09 of the tightening can be signaled S10 to the operator, this can be done visually, tactile or through a sound signal.

In the following some exemplary values are given for the various thresholds:

The initial tightening phase ITP is measured as a time period and it may be in the range of 100 ms to 200 ms, preferably in the range of 120 ms to 180 ms and more preferably in the range of 125 to 160 ms, whereby ms are milliseconds. The initial tightening phase ITP is measured from the moment the acceleration of the rotational parts 10, 11 up to the first rotational threshold value R1 starts.

Alternatively to the above the initial tightening phase ITP is measured in angle of rotation of the rotational parts and is in the range of 180° to 1080°, preferably 360° to 720° and more preferably 430° to 650°.

The target fastening value T2 can correspondingly to the above be a target torque value T2 and the predetermined torque threshold value T1 is typically in a range of 7 Nm to 12 Nm, preferably 8 to 11 Nm and more preferably 8.5 Nm to 10 Nm, whereby Nm is Newton meter. It is however clear to the skilled person that these values are not absolute. Different applications and joints may require higher or lower torque values.

The predetermined torque threshold value T1 is typically in a range of 10% to 50% of the target fastening value/target torque value T2, preferably 15% to 25% of the target fastening value/target torque value T2.

Alternatively to the above the target fastening value T2 is an angle, which tightens the joint and fastener, respectively according to the specification. This may be the case if an angle controlled device is used.

The first rotational threshold value T1 is in the range of 800 revolutions per minute to 1200 revolutions per minute, preferably about 900 to 1100 revolutions per minute.

The second rotational threshold value is in the range of 2000 revolutions per minute to 4000 revolutions per minute, preferably about 2500 revolutions per minute to 3500 revolutions per minute and more preferably about 2800 revolutions per minute to 3200 revolutions per minute.

As mentioned the given values above are examples for a torque environment of approximately 20 Nm to 55 Nm. The method can however be applied and scaled to other torque environments that are higher or lower as the given examples. The method is thus in no way limited to a specific torque environment.

The invention claimed is:

1. A method for detecting whether a fastener is already tightened, using a tightening tool with a pulse mechanism, the method comprising:

placing the tightening tool on the fastener;

accelerating rotational parts of the tightening tool;

limiting a rotational speed of the rotational parts to a first rotational threshold value in revolutions per minute during an initial tightening phase, the first rotational threshold value being set to be in a range of 20% to 80% of a second rotational threshold value in revolutions per minute needed in a secondary tightening phase to provide a target fastening value for the fastener;

detecting whether a pulse occurs during the initial tightening phase, the initial tightening phase being measured from a moment when the rotational parts are accelerated; and detecting that no pulse has occurred and accelerating the rotational parts of the tightening tool up to the second rotational threshold value in response to the detection that no pulse has occurred.

2. The method according to claim 1, further comprising: detecting that the pulse occurs, and detecting a torque value of the pulse.

3. The method according to claim 2, further comprising: determining that the torque value is at or above a predetermined torque threshold value, and aborting tightening in response to the determination.

4. The method according to claim 3, wherein the target fastening value is a target torque value, and wherein the predetermined torque threshold value is in a range of 7 Nm to 12 Nm.

5. The method according to claim 2, further comprising: determining that the torque value is below a predetermined threshold value, and accelerating the rotational parts of the tightening tool up to the second rotational threshold value in response to the determination.

6. The method according to claim 2, further comprising: signaling to an operator that the fastener is already tightened.

7. The method according to claim 1, wherein the initial tightening phase is measured in time and is in a range of 100 ms to 200 ms.

8. The method according to claim 7, wherein the initial tightening phase is in a range of 120 ms to 180 ms.

9. The method according to claim 8, wherein the initial tightening phase is in a range of 125 to 160 ms.

10. The method according to claim 1, wherein the initial tightening phase is measured in angle and is in a range of 180° to 1080°.

11. The method according to claim 10, wherein the initial tightening phase is in a range of 360° to 720°.

12. The method according to claim 11, wherein the initial tightening phase is in a range of 430° to 650°.

13. The method according to claim 1, wherein the first rotational threshold value is in a range of 800 revolutions per minute to 1200 revolutions per minute.

14. The method according to claim 13, wherein the first rotational threshold value is in a range of 900 to 1100 revolutions per minute.

15. The method according to claim 1, wherein the second rotational threshold value is in a range of 2000 revolutions per minute to 4000 revolutions per minute.

16. The method according to claim 15, wherein the second rotational threshold value is in a range of 2500 revolutions per minute to 3500 revolutions per minute.

17. The method according to claim 16, wherein the second rotational threshold value is in a range of 2800 revolutions per minute to 3200 revolutions per minute.

18. The method according to claim 1, wherein the target fastening value is a target torque value or target angle value.

19. The method according to claim 1, wherein the tightening tool is an electronic tightening tool, a pneumatic tightening tool, or a hydraulic tightening tool.

20. A tightening tool comprising:

a pulse mechanism;

a motor;

a drive member;

a measurement unit; and a processing unit connected to the measurement unit, wherein the motor is configured to drive the drive member, wherein the pulse mechanism is configured to rotate along with the drive member, wherein the measurement unit is configured to measure at least one of an angle, an applied torque, pulse, and time, and wherein the processing unit is configured to control the tightening tool to perform operations comprising:

accelerating rotational parts of the tightening tool;

limiting a rotational speed of the rotational parts to a first rotational threshold value in revolutions per minute during an initial tightening phase, the first rotational threshold value being set to be in a range of 20% to 80% of a second rotational threshold value in revolutions per minute needed in a secondary tightening phase to provide a target fastening value for a fastener;

detecting whether a pulse occurs during the initial tightening phase, the initial tightening phase being measured from a moment when the rotational parts are accelerated; and accelerating the rotational parts of the tightening tool up to the second rotational threshold value if no pulse is detected.

* * * * *